US005925987A

United States Patent [19]

Zöchbauer et al.

[11] Patent Number: 5,925,987

[45] Date of Patent: Jul. 20, 1999

[54] PRINTED CIRCUIT BOARD MOUNTED ELECTRODELESS GAS DISCHARGE LAMP

[75] Inventors: Michael Zöchbauer, Oberusel, Austria; Marek Rolski; Walter Fabinski, both of Kriftel, Germany; Raig Kaufer, Königs Wusterhausen, Germany; F. P. Herrmann, Berlin, Germany; V. L. Budovich, Moskau, Russian Federation

[73] Assignee: Hartmann & Braun GmbH & Co. KG, Frankfurt, Germany

[21] Appl. No.: 08/896,777

[22] Filed: Jul. 18, 1997

[51] Int. Cl.[6] ..... H05B 41/16

[52] U.S. Cl. ..... 315/248; 331/3; 331/94.1; 313/573

[58] Field of Search ..... 315/248, 39, 344; 331/3, 94.1; 313/490, 493, 573

[56] References Cited

U.S. PATENT DOCUMENTS

| | | | |
|---|---|---|---|
| 4,434,406 | 2/1984 | Fowks | 331/3 |
| 4,622,495 | 11/1986 | Smeelen | 315/248 |
| 4,661,746 | 4/1987 | Postma et al. | 315/248 |
| 4,673,846 | 6/1987 | Yoshizawa et al. | 315/248 |
| 5,032,757 | 7/1991 | Witting | 315/248 X |
| 5,592,048 | 1/1997 | Wei et al. | 313/570 |
| 5,682,080 | 10/1997 | Dolan et al. | 313/570 |

*Primary Examiner*—Don Wong
*Assistant Examiner*—Haissa Philogene
*Attorney, Agent, or Firm*—Michael M. Rickin

[57] ABSTRACT

An electrodeless discharge lamp having a gas filling consisting of a gas mixture for generating gas-specific resonance radiation, wherein the lamp vessel is made of glass. To facilitate replacement and mounting of the electrodeless lamp, the discharge lamp is arranged within a metallic housing and the lamp vessel is disposed together with the high frequency coil as well as any electronic elements on a printed circuit board which is connected with the cover of the lamp housing.

13 Claims, 2 Drawing Sheets

Schematische Innenansicht EDL

PRINTED CIRCUIT BOARD MOUNTED ELECTRODELESS GAS DISCHARGE LAMP

FIELD OF THE INVENTION

This invention relates to an electrodeless gas discharge lamp filled with a gas mixture and generating a corresponding gas-specific electromagnetic resonance radiation, wherein the lamp vessel, i.e. the discharge vessel is made of glass.

DESCRIPTION OF THE PRIOR ART

Lamps of this type having a nitrogen filling, for example, are used for resonance measurements in the ultraviolet spectrum. Such lamps do not have any interior electrodes, i.e. electrodes that are disposed within the glass body. The corresponding gas-specific radiation is generated by a plasma discharge. Thus, important operating parameters are on the one hand the filled concentration ratios and on the other hand the partial pressure of the gas or the gas component which is decisive for the desired radiation. The so-called plasma discharge is generated via a coil to which a high frequency is applied. The radiation generating mechanisms during the plasma discharge are essentially impact ionization processes. During such impact ionization processes, the molecules of the gas are either dissociated and/or partially or completely liberated from their electron envelopes. The gas takes the required energy from the high frequency field.

Due to the fact that said lamps lack electrodes, the otherwise usual gas consumption of electrodes is also lacking. In most cases, electrodeless lamps of this type are permanently built into a lamp housing. The lamp is expected to be replaced only in case of damage. Since the discharge lamp, filled with a specific filling, usually generates specific radiation or radiation within a specific spectral range, resonance measurements of different gases require a different radiation source. Frequently, the lamps form part of a complete measuring device. As a result, if different gas components need to be measured, the radiation sources must frequently be replaced together with their housing and, if applicable, their electronic components. There is also the additional problem of optimizing the adjustment of the desired emitted radiation. With different gas discharge lamps, there are of course different optimum parameters for each lamp based either on a different filling or the application of different energies. As a result, to ensure optimum radiation emission in each case, the electronic components of discharge lamps of the known type frequently also need to be replaced. Overall, replacing the radiation source becomes costly.

It is therefore an object of the invention to further develop an electrodeless lamp of the generic type to facilitate its replacement.

In an electrodeless lamp of the generic type, the object of the invention is attained by disposing the electrodeless lamp inside a high frequency coil which in turn is mounted on a printed circuit board, with the printed circuit board forming part of the housing cover of the lamp housing.

SUMMARY OF THE INVENTION

An electrodeless glass gas discharge lamp that is in a metallic housing where the glass lamp vessel together with a high frequency coil and any electronic components are on a PC board which is connected to the housing cover. There is a gas filling in the lamp vessel and the lamp vessel has two cylindrical glass bodies of different diameters which are connected to each other in a manner to keep the gas filling in the two cylindrical bodies and such that the axes of the two bodies are not in alignment with each other.

An electrodeless glass gas discharge lamp as above which further has in the lamp housing an opening which is aligned with a resonance radiation outlet area of the lamp vessel.

DESCRIPTION OF THE PREFERRED EMBODIMENTS

Figure 1:
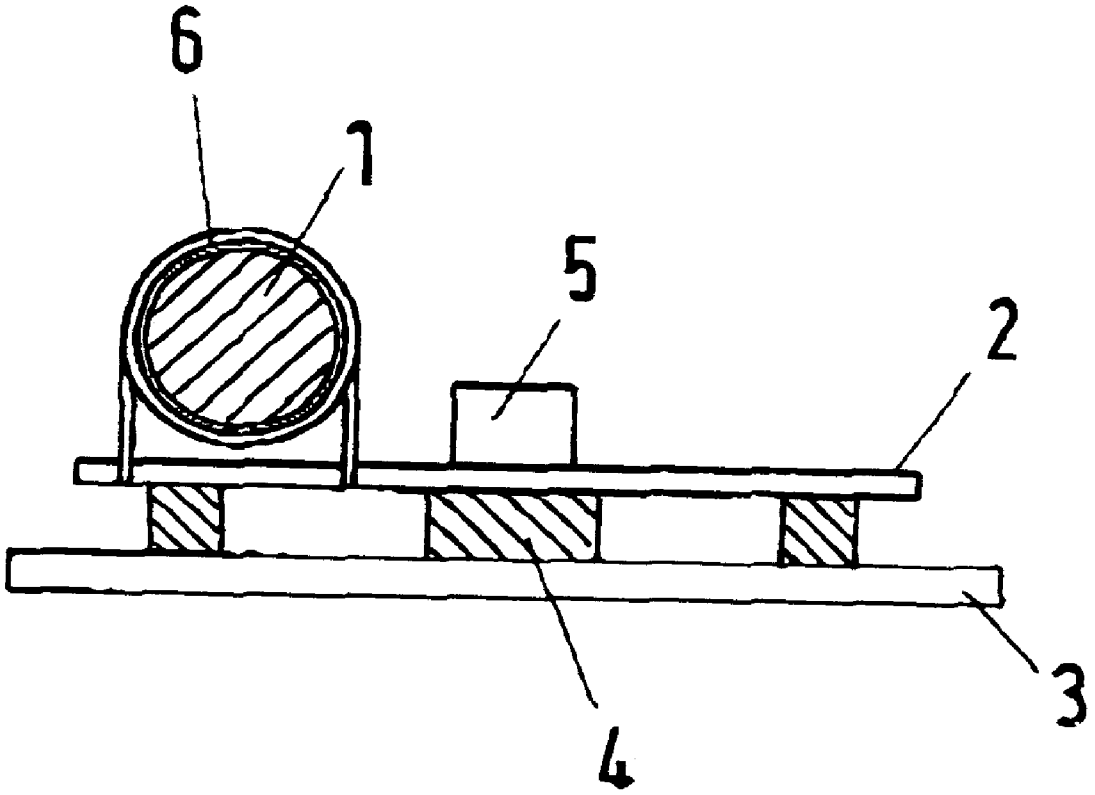
FIG. 1 shows a side view of the printed circuit board with cover, lamp and coil.

FIG. 1 shows a side elevation of a cross section through lamp housing 10 in the area of high frequency coil 6. The spatial arrangement of the individual elements is evident from FIG. 2. The sectional side view of FIG. 1 shows that the high frequency coil 6 is mounted on the printed circuit board 2, that is, the coil's electrical connections are made via the printed circuit board. In addition to high frequency coil 6, the actual control transistor 5 of coil 6 is also disposed on printed circuit board 2. With respect to its design, the transistor is tuned to the corresponding specific high frequency coil. The discharge tube with the corresponding glass body segment is inserted into the high frequency coil. The printed circuit board 2 itself is connected via heat dissipation elements 4 to the metallic cover 3 of the lamp housing 10 which is depicted in more detail in FIG. 2. The heat loss of the transistor as well as the high frequency coil is removed via the heat dissipation elements to the metallic cover. The cover then acts as the heat emission surface of these components.

Figure 2:
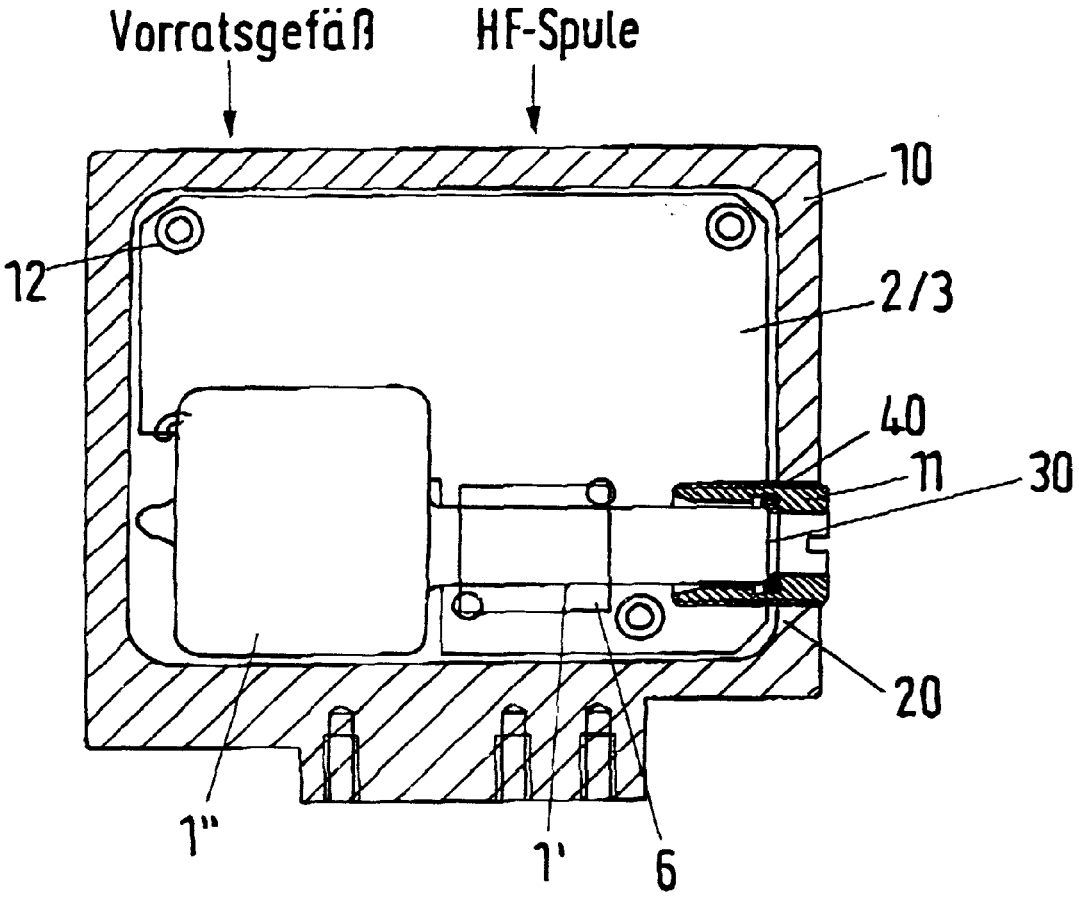
FIG. 2 shows a sectional view showing the mounted lamp housing.

FIG. 2 shows a top view of a section through lamp housing 10. Cover 3 according to the invention depicted in FIG. 1 together with printed circuit board 2, lamp 1 and electrical elements 5, 6 are introduced from below into housing 10 so as to give a view onto printed circuit board 2 through the lamp housing which is opened in cross section. It can be seen from FIG. 1 that lamp vessel 1 does not consist of a uniform cylindrical glass body but of two glass bodies 1', 1" which have different diameters.

The glass bodies per se are cylindrical and the thickened glass body area 1" does not lie along the same axis as the rest of lamp vessel 1' but eccentrically thereto. The thickened lamp vessel section 1" acts as storage vessel into which the gas mixture is introduced. However, the two lamp vessel segments 1', 11" are connected with each other in a gas-tight manner. The eccentric arrangement generates corresponding gas exchange dynamics but does not interfere with the direct discharge process within the thinner cylindrical section 1' of the lamp vessel. The figure furthermore shows high frequency coil 6 which in this case encircles the lamp vessel in a certain position. It is there that the resonance radiation is generated, with the generating location, according to the invention, being greater than or equal to the vessel radius of such lamp segment 1'. The end of lamp vessel 1 pointing towards the right, on the corresponding surface, is provided with a so-called outlet window 30. Within housing 10, a corresponding opening 40 is made which is aligned with outlet window 30 of mounted lamp 1. Such housing opening 40 is furthermore provided with an internal thread to receive screw element 11 which has the shape of a hollow cylinder and is provided with an external thread. In its design position, this hollow cylindrical screw element 11 encircles lamp vessel 1 along a portion of area 1'. Extending along the front edge of lamp vessel 1 is a support face to receive sealing ring 20 which is disposed inside hollow cylindrical screw element 11. Such sealing ring 20 lies in a groove within the hollow cylindrical screw element and, in its desired screwed-in position, holds the lamp vessel in correspondingly centered position, i.e. in a resilient manner. This prevents breakage of the lamp vessel in case of shock. The hollow cylindrical screw element is provided with a corresponding central opening the size of the outlet window through which the desired radiation can be emitted. The figure furthermore shows that cover 3 and printed circuit board 2, respectively, are provided with mounting openings and mounting elements 12 which are used to mount cover 3 together with lamp 1 and printed circuit board 2 in housing 10 by means of screws.

As described above, cover 3 is selected in such a way that it seals housing 10 to make it high frequency tight such that practically none of the electromagnetic energy generated in the high frequency coil passes through to the outside but is short-circuited via the wall of metallic lamp housing 10.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. Electrodeless discharge lamp having a lamp vessel and a gas filling, said gas filing in said lamp vessel and comprised of a gas mixture for generating corresponding gas-specific resonance radiation, wherein the lamp vessel is made of glass, characterized in that the discharge lamp can be disposed within a metallic housing, said lamp vessel together with a high frequency coil as well as any electronic elements are disposed on a printed circuit board which is connected with a cover of said lamp housing and said lamp vessel comprises two cylindrical glass bodies of different diameters which are connected with each other in a manner to keep said gas filling in said two cylindrical bodies and such that the two axes of the cylindrical glass bodies are not aligned with each other.

2. Electrodeless lamp in accordance with claim 1, characterized in that said lamp housing has an opening which is aligned with a resonance radiation outlet area of said lamp vessel.

3. Electrodeless lamp in accordance with claim 2, characterized in that a positioning element can be introduced through said lamp housing opening and mechanically coupled with said lamp vessel and that an opening is formed in said positioning element to permit the passage of the generated gas specific resonance radiation.

4. Electrodeless lamp in accordance with claim 3, characterized in that said positioning element is a mechanical screw element.

5. Electrodeless lamp in accordance with claim 1, characterized in that one of said two glass bodies is disposed within said high frequency coil.

6. Electrodeless lamp in accordance with claim 2, characterized in that one of said two glass bodies is disposed within said high frequency coil.

7. Electrodeless lamp in accordance with claim 3, characterized in that one of said two glass bodies is disposed within said high frequency coil.

8. Electrodeless discharge lamp having a lamp vessel made of glass and a gas filling, said gas filling in said lamp vessel and comprised of a gas mixture for generating corresponding gas-specific resonance radiation, characterized in that the discharge lamp can be disposed within a metallic housing, said lamp vessel together with a high frequency coil as well as any electronic elements are disposed on a printed circuit board which is connected with a cover of said lamp housing, said lamp housing has an opening which is aligned with a resonance radiation outlet area of said lamp vessel and said lamp vessel comprises two cylindrical glass bodies of different diameters which are connected with each other in a manner to keep said gas filling in said two cylindrical glass bodies and such that the two axes of the cylindrical glass bodies are not aligned with each other.

9. Electrodeless lamp in accordance with claim 8, characterized in that a positioning element can be introduced through said housing opening and mechanically coupled with said lamp vessel and an opening is formed in said positioning element to permit the passage of said generated gas specific resonance radiation.

10. Electrodeless lamp in accordance with claim 9, characterized in that said positioning element is a mechanical screw.

11. Electrodeless lamp in accordance with claim 8, characterized in that one of said two glass bodies is disposed within said high frequency coil.

12. Electrodeless lamp in accordance with claim 8, characterized in that one of said two glass bodies is disposed within said high frequency coil.

13. Electrodeless lamp in accordance with claim 10, characterized in that one of said two glass bodies is disposed within said high frequency coil.

* * * * *